US010260194B2

(12) United States Patent
Green et al.

(10) Patent No.: US 10,260,194 B2
(45) Date of Patent: Apr. 16, 2019

(54) LAUNDRY TREATING APPLIANCE WITH A SENSOR

(71) Applicant: WHIRLPOOL CORPORATION, Benton Harbor, MI (US)

(72) Inventors: Jason A. Green, Stevensville, MI (US); Alexander Halbleib, Saint Joseph, MI (US); Roy E. Masters, Saint Joseph, MI (US); Arun Rajendran, St. Joseph, MI (US); Wesley P. Traylor, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 316 days.

(21) Appl. No.: 15/210,952

(22) Filed: Jul. 15, 2016

(65) Prior Publication Data

US 2018/0016734 A1 Jan. 18, 2018

(51) Int. Cl.

| | |
|---|---|
| ***D06F 58/28*** | (2006.01) |
| ***D06F 25/00*** | (2006.01) |
| ***D06F 58/02*** | (2006.01) |
| ***D06F 58/20*** | (2006.01) |
| ***D06F 58/04*** | (2006.01) |

(52) U.S. Cl.

CPC ..... *D06F 58/28* (2013.01); *D06F 25/00* (2013.01); *D06F 58/02* (2013.01); *D06F 58/04* (2013.01); *D06F 58/203* (2013.01); *D06F 2058/2803* (2013.01); *D06F 2058/2829* (2013.01); *D06F 2058/2835* (2013.01); *D06F 2058/2838* (2013.01); *D06F 2058/2861* (2013.01)

(58) Field of Classification Search

CPC ..... D06F 58/28; D06F 25/00; D06F 58/02; D06F 58/04; D06F 58/203; D06F 2058/2803; D06F 2058/2829; D06F 2058/2835; D06F 2058/2838; D06F 2058/2861

USPC ..... 34/486

See application file for complete search history.

(56) References Cited

U.S. PATENT DOCUMENTS

| | | | | |
|---|---|---|---|---|
| 3,497,964 A * | 3/1970 | Elders | D06F 58/28 34/533 |
| 5,315,765 A | 5/1994 | Holst et al. | |
| 5,737,852 A * | 4/1998 | Shukla | D06F 58/28 307/650 |

(Continued)

FOREIGN PATENT DOCUMENTS

| | | |
|---|---|---|
| DE | 2819173 A1 | 11/1979 |
| DE | 2839333 A1 | 3/1980 |

(Continued)

OTHER PUBLICATIONS

European Search Report for Counterpart EP17180141.8, dated Nov. 23, 2017.

*Primary Examiner* — Stephen M Gravini
(74) *Attorney, Agent, or Firm* — McGarry Bair PC

(57) ABSTRACT

An apparatus and method towards a laundry treating appliance for drying laundry comprising a rotatable drum at least partially defining a treating chamber and having a front and a rear where at least one conductivity sensor is located within the treating chamber, and a motor rotating the drum tumbles laundry within the treating chamber to ensure contact of the laundry with the conductivity sensor.

20 Claims, 7 Drawing Sheets

(56) References Cited

U.S. PATENT DOCUMENTS

| | | | | |
|---|---|---|---|---|
| 5,755,041 | A * | 5/1998 | Horwitz | D06F 58/28 34/491 |
| 5,940,986 | A * | 8/1999 | Jelinek | D06F 58/04 34/528 |
| 7,005,618 | B2 | 2/2006 | Riddle et al. | |
| 7,975,400 | B2 * | 7/2011 | Dittmer | D06F 58/28 204/560 |
| 8,087,182 | B2 | 1/2012 | Steffens | |
| 8,468,717 | B2 * | 6/2013 | Bellinger | D06F 58/28 34/491 |
| 9,080,283 | B2 | 7/2015 | Bellinger et al. | |
| 9,200,842 | B2 | 12/2015 | Hopkins | |
| 9,249,539 | B2 | 2/2016 | Hubig et al. | |
| 9,322,127 | B2 | 4/2016 | Ashrafzadeh et al. | |
| 9,593,442 | B2 * | 3/2017 | Bellinger | D06F 58/28 |
| 9,915,023 | B2 * | 3/2018 | Noh | D06F 58/28 |
| 2010/0037480 | A1 | 2/2010 | Steffens | |
| 2011/0203131 | A1 | 8/2011 | Armstrong | |
| 2012/0096737 | A1 * | 4/2012 | Kmet | D06F 39/003 34/443 |
| 2012/0096738 | A1 | 4/2012 | Bellinger et al. | |
| 2014/0259441 | A1 | 9/2014 | Fulmer et al. | |
| 2015/0152588 | A1 | 6/2015 | Bae et al. | |
| 2015/0240407 | A1 | 8/2015 | Hendrickson et al. | |
| 2015/0368853 | A1 | 12/2015 | Kulkarni et al. | |
| 2016/0060806 | A1 | 3/2016 | Morin et al. | |
| 2018/0016734 | A1 * | 1/2018 | Green | D06F 25/00 |

FOREIGN PATENT DOCUMENTS

| | | | | |
|---|---|---|---|---|
| DE | 3345303 | A1 * | 6/1985 | D06F 58/04 |
| DE | 102012107218 | A1 * | 4/2013 | D06F 58/28 |
| EP | 1148169 | A2 | 10/2001 | |
| EP | 1443139 | A1 * | 8/2004 | D06F 39/003 |
| EP | 2196576 | A1 * | 6/2010 | D06F 58/203 |
| EP | 2653602 | A1 * | 10/2013 | F26B 21/00 |
| EP | 2516719 | B1 | 11/2013 | |
| EP | 2716810 | A1 * | 4/2014 | D06F 58/28 |
| EP | 2653602 | B1 * | 12/2016 | F26B 21/00 |
| EP | 3269872 | A1 * | 1/2018 | D06F 25/00 |
| WO | WO 2016138920 | A1 * | 9/2016 | D06F 58/206 |
| WO | WO 2018024580 | A1 * | 2/2018 | |

* cited by examiner

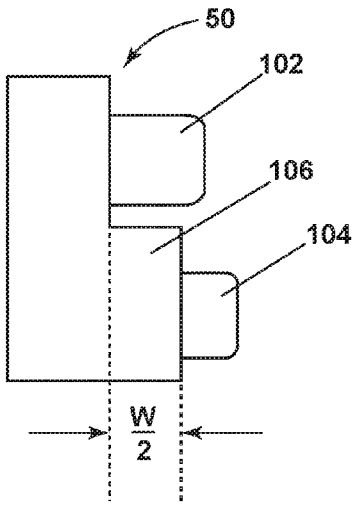
FIG. 3A
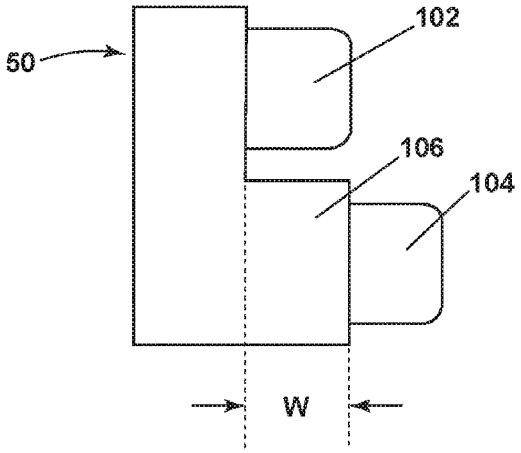
FIG. 3B
FIG. 3C
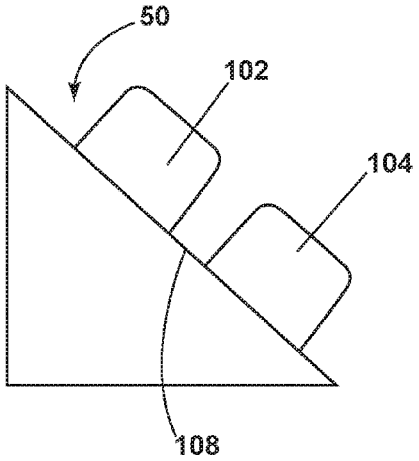

LAUNDRY TREATING APPLIANCE WITH A SENSOR

BACKGROUND OF THE INVENTION

Laundry treating appliances, in particular clothes dryers, can have a configuration based on a rotating drum that defines a treating chamber in which laundry items are placed for treating according to a cycle of operation. A dispensing system can be provided for dispensing a treating chemistry as part of the cycle of operation. A controller can be operably connected with the dispensing system and can have various components of the laundry treating appliance to execute the cycle of operation. The cycle of operation can be selected manually by the user or automatically based on one or more conditions determined by the controller.

The effectiveness of the clothes dryer is based on how dry laundry is at the end of a cycle. Too dry of laundry, such as "bone dry" is harsh on the laundry and wastes energy as the laundry is over-dried, and not dry enough feels wet to the consumer, which can lead to an unnecessary service call. Typically, it is desired to stop the drying cycle when the laundry has a desired residual moisture content falling within a particular range (e.g., 2-4%). Determining the residual moisture content to set the "dryness" of the laundry can improve appliance efficiency and consumer satisfaction. Sensors can be utilized to determine the moisture content in a load of laundry and communicate this information to the controller. However, many of the sensors currently used have difficulty accurately determining when moisture content is in the desired range (e.g., 2-4%).

SUMMARY

The present disclosure sets forth systems, components, and methodologies for a laundry treating appliance for drying laundry. The laundry treating appliance includes a rotatable drum at least partially defining a treating chamber and having a front and a rear, a first conductivity sensor located at the rear of the treating chamber, a second conductivity sensor located at the front of the treating chamber, and a motor rotating the drum at a predetermined speed to tumble laundry within the treating chamber such that the laundry passes over the first conductivity sensor.

Methods in accordance with the present disclosure control a drying cycle of operation in a laundry treating appliance for drying laundry, including to rotate a treating chamber at a predetermined speed such that laundry within the treat chamber tumbles along a predetermined trajectory that passes over a first conductivity sensor located at a rear of the treating chamber and a second conductivity sensor at the front of the treating chamber.

Methods in accordance with the present disclosure control a drying cycle of operation in a laundry treating appliance for drying laundry, including to rotate a treating chamber, receive at a controller for the laundry treating appliance a first conductivity signal from a first conductivity sensor at a rear of the treating chamber and a second conductivity signal from a second conductivity sensor at a front of the treating chamber, select by the controller the one of the first and second conductivity signals having the greater number of conductivity sensings, and control the duration of the drying cycle of operation based on the selected one of the first and second conducting signals.

BRIEF DESCRIPTION OF THE DRAWINGS

In the drawings:

FIGS. 3A, 3B, 3C, 3D are schematic cross sections of different orientations for metal electrodes of the conductivity sensor from FIG. 1.

DESCRIPTION OF EMBODIMENTS OF THE INVENTION

Figure 1:
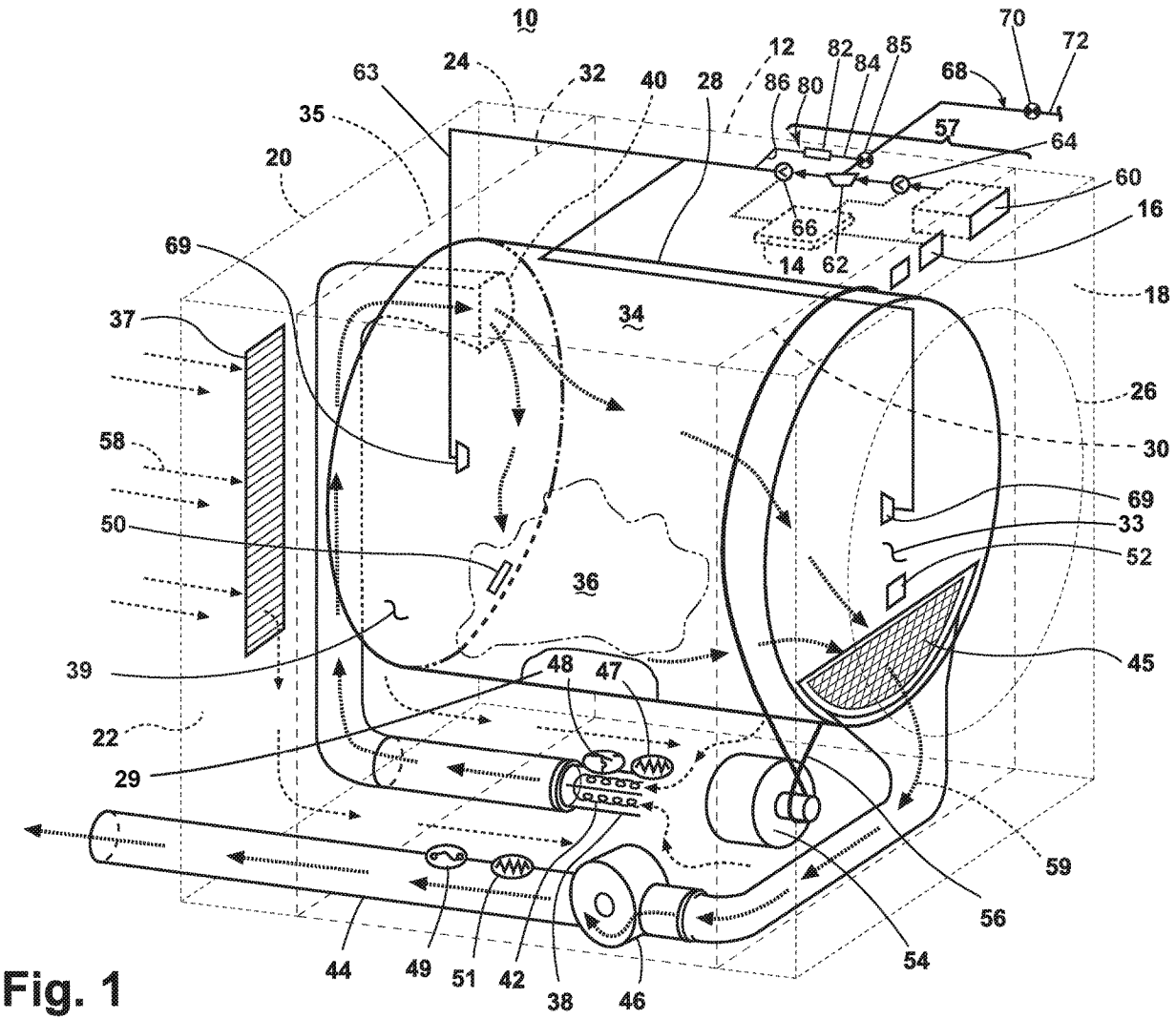
FIG. 1 is a schematic view of a laundry treating appliance in the form of a clothes dryer having a moisture sensor in the form of conductivity sensor.

FIG. 1 is a schematic view of a laundry treating appliance 10 in the form of a clothes dryer 10 that can be controlled according to one embodiment of the invention. While the embodiments of the invention are described in the context of a clothes dryer 10, the embodiments of the invention can be used with any type of laundry treating appliance, non-limiting examples of which include a washing machine, a combination washing machine and dryer and a refreshing/revitalizing machine.

As illustrated in FIG. 1, the clothes dryer 10 can include a cabinet 12 in which is provided a controller 14 that can receive input from a user through a user interface 16 for selecting a cycle of operation and controlling the operation of the clothes dryer 10 to implement the selected cycle of operation.

The cabinet 12 can be defined by a front wall 18, a rear wall 20, and a pair of side walls 22 supporting a top wall 24. A chassis can be provided with the walls being panels mounted to the chassis. A door 26 can be hingedly mounted to the front wall 18 and can be selectively movable between opened and closed positions to close an opening in the front wall 18, which provides access to the interior of the cabinet 12.

A rotatable drum 28 can be disposed within the interior of the cabinet between opposing stationary front and rear ends comprising bulkheads 30, 32 wherein the front bulkhead 30 rotationally supports an open front 33 and the rear bulkhead 32 defines a rear wall 35 closing an open rear 39 of the drum 28. The rear wall 35 along with the door 26 and the rotatable drum 28 collectively define a treating chamber 34. As illustrated, the treating chamber 34 is not fluidly coupled to a drain, though other implementations may include drain lines. Thus, in this implementation, liquid introduced into the treating chamber 34 will not be removed merely by draining.

Non-limiting examples of laundry that can be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), can be treated in the clothes dryer 10.

The drum 28 can include at least one lifter 29. In most dryers, there can be multiple lifters. The lifters can be located along an inner surface of the drum 28 defining an interior circumference of the drum 28. The lifters can facilitate movement of the laundry 36 within the drum 28 as the drum 28 rotates.

The drum 28 can be operably coupled with a motor 54 to selectively rotate the drum 28 during a cycle of operation. The coupling of the motor 54 to the drum 28 can be direct or indirect. As illustrated, an indirect coupling can include a belt 56 coupling an output shaft of the motor 54 to a wheel/pulley on the drum 28. A direct coupling can include the output shaft of the motor 54 coupled to a hub of the drum 28.

An air system can be provided to the clothes dryer 10. The air system supplies air to the treating chamber 34 and exhausts air from the treating chamber 34. The supplied air can be heated or not. The air system can have an air supply portion that can form, in part, a supply conduit 38, which has one end open to ambient air via a rear vent 37 and another end fluidly coupled to an inlet grill 40, which can be in fluid communication with the treating chamber 34. A heating element 42 can lie within the supply conduit 38 and can be operably coupled to and controlled by the controller 14. If the heating element 42 is turned on, the supplied air will be heated prior to entering the drum 28.

The air system can further include an air exhaust portion that can be formed in part by an exhaust conduit 44. A lint trap 45 can be provided as the inlet from the treating chamber 34 to the exhaust conduit 44. A blower 46 can be fluidly coupled to the exhaust conduit 44. The blower 46 can be operably coupled to and controlled by the controller 14. Operation of the blower 46 draws air into the treating chamber 34 as well as exhausts air from the treating chamber 34 through the exhaust conduit 44. The exhaust conduit 44 can be fluidly coupled with a household exhaust duct (not shown) for exhausting the air from the treating chamber 34 to the outside of the clothes dryer 10.

The air system can further include various sensors and other components, such as a first thermistor 47 and a thermostat 48, which can be coupled to the supply conduit 38 in which the heating element 42 can be positioned. The thermistor 47 and the thermostat 48 can be operably coupled to each other. Alternatively, the thermistor 47 can be coupled to the supply conduit 38 at or near to the inlet grill 40. Regardless of its location, the thermistor 47 can be used to aid in determining an inlet temperature. A second thermistor 51 and a thermal fuse 49 can be coupled to the exhaust conduit 44, with the thermistor 51 being used to determine an outlet air temperature.

A first conductivity sensor 50 can be positioned in the interior of the treating chamber 34 to monitor the amount of moisture of the laundry in the treating chamber 34. The first conductivity sensor 50 can be mounted at the rear of the treating chamber, for example, on the rear bulkhead 32 or real wall 35 as illustrated. A second conductivity sensor 52 can be located at the front of the treating chamber 34 integrated with the lint trap 45 or at another any location in the interior of the dispensing dryer 10 such that the conductivity sensor 52 can accurately sense the moisture content of the laundry. The conductivity sensors 50, 52 can be operably coupled to the controller 14 such that the controller 14 receives output from the conductivity sensors 50, 52. While two conductivity sensors 50, 52 are illustrated, this is not meant to be limiting and other configurations can be contemplated.

The determination of a "dry" load can be based on the moisture content of the laundry, which may be set by the user based on the selected cycle, an option to the selected cycle, or a user-defined preference. The moisture content can be determined using a single moisture sensor, such as a conductivity sensor, located at the front of the treating chamber. The conductivity sensor can be used to calculate a projected drying time. In exemplary implementations, the conductivity sensors are not used for an absolute determination of dryness because they may not be accurate below approximately 10% moisture content and a load (at least in certain exemplary implementations) is typically not considered dry unless it has less than 5% moisture content or, more typically, 2-4%, Thus, the output of the conductivity sensor is used to calculate a drying time that is expected to have less than moisture content.

Together the first and second thermistors 47, 51 can provide a thermal signal for an end of cycle estimation when either a signal from the conductivity sensors is no longer being produced because all of the laundry is wet, or an error has occurred. Additionally, when the dryness level drops below 10% a thermal signal from the first and second thermistors 47, 51 can be utilized to determine an end of cycle estimation time.

Together the first and second thermistors 47, 51 along with the first and second conductivity sensors 50, 52 can provide information as a single model to the controller 14. The single model can use information from the first and second thermistor 47, 51 to determine the temperature differential between incoming and outgoing air. This information can be in addition to or compared with the moisture content of the laundry sensed by the first and second conductivity sensors. These four pieces of input can together form the single model necessary for determining an end of cycle for the clothes dryer 10.

Specific algorithms for determining the end of cycle for the clothes dryer using temperature profiles from a thermistor can be found in U.S. Pat. No. 9,080,283, entitled "Method to Control a Drying Cycle of a Laundry Treating Appliance" assigned to Whirlpool Corporation which is hereby incorporated by reference in its entirety. Algorithms for determining the end of cycle for the clothes dryer using sensor feedback from at least one of a thermistor or conductivity sensor can be found in U.S. Pat. No. 9,322,127, entitled "Method for Operating a Home Appliance" assigned to Whirlpool Corporation which is also hereby incorporated by reference.

A dispensing system 57 can be provided for the clothes dryer 10 to dispense one or more treating chemistries to the treating chamber 34 according to a cycle of operation. As illustrated, the dispensing system 57 can be located in the interior of the cabinet 12 although other locations are also possible. The dispensing system 57 can be fluidly coupled to a water supply 68. The dispensing system 57 can be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible.

As illustrated, the dispensing system 57 can include a reservoir 60, which can be a cartridge, for a treating chemistry that is releasably coupled to the dispensing system 57, which dispenses the treating chemistry from the reservoir 60 to the treating chamber 34. The reservoir 60 can include one or more cartridges configured to store one or more treating chemistries in the interior of cartridges. A suitable cartridge system can be found in U.S. Pub. No. 2015/240407 to Hendrickson et al., filed Apr. 28, 2015, entitled "Method for Converting a Household Cleaning Appliance with a Non-Bulk Dispensing System to a Household Cleaning Appliance with a Bulk Dispensing System," now U.S. Pat. No. 9,920,468, issued Mar. 20, 2018, which is herein incorporated by reference in its entirety.

A mixing chamber 62 can be provided to couple the reservoir 60 to the treating chamber 34 through a supply conduit 63. Pumps such as a metering pump 64 and a delivery pump 66 can be provided to the dispensing system 57 to selectively supply a treating chemistry and/or liquid to the treating chamber 34 according to a cycle of operation. The water supply 68 can be fluidly coupled to the mixing chamber 62 to provide water from the water source to the mixing chamber 62. The water supply 68 can include an inlet valve 70 and a water supply conduit 72. It is noted that, instead of water, a different treating chemistry can be provided from the exterior of the clothes dryer 10 to the mixing chamber 62.

The treating chemistry can be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 can also be provided with a steam generating system 80 which can be separate from the dispensing system 57 or integrated with portions of the dispensing system 57 for dispensing steam and/or liquid to the treating chamber 34 according to a cycle of operation. The steam generating system 80 can include a steam generator 82 fluidly coupled with the water supply 68 through a steam inlet conduit 84. A fluid control valve 85 can be used to control the flow of water from the water supply conduit 72 between the steam generating system 80 and the dispensing system 57. The steam generator 82 can further be fluidly coupled with the one or more supply conduits 63 through a steam supply conduit 86 to deliver steam to the treating chamber 34 through the nozzles 69. Alternatively, the steam generator 82 can be coupled with the treating chamber 34 through one or more conduits and nozzles independently of the dispensing system 57.

The steam generator 82 can be any type of device that converts the supplied liquid to steam. For example, the steam generator 82 can be a tank-type steam generator that stores a volume of liquid and heats the volume of liquid to convert the liquid to steam. Alternatively, the steam generator 82 can be an in-line steam generator that converts the liquid to steam as the liquid flows through the steam generator 82.

It will be understood that any suitable dispensing system and/or steam generating system can be used with the dryer 10. It is also within the scope of the invention for the dryer 10 to not include a dispensing system or a steam generating system.

Figure 2:
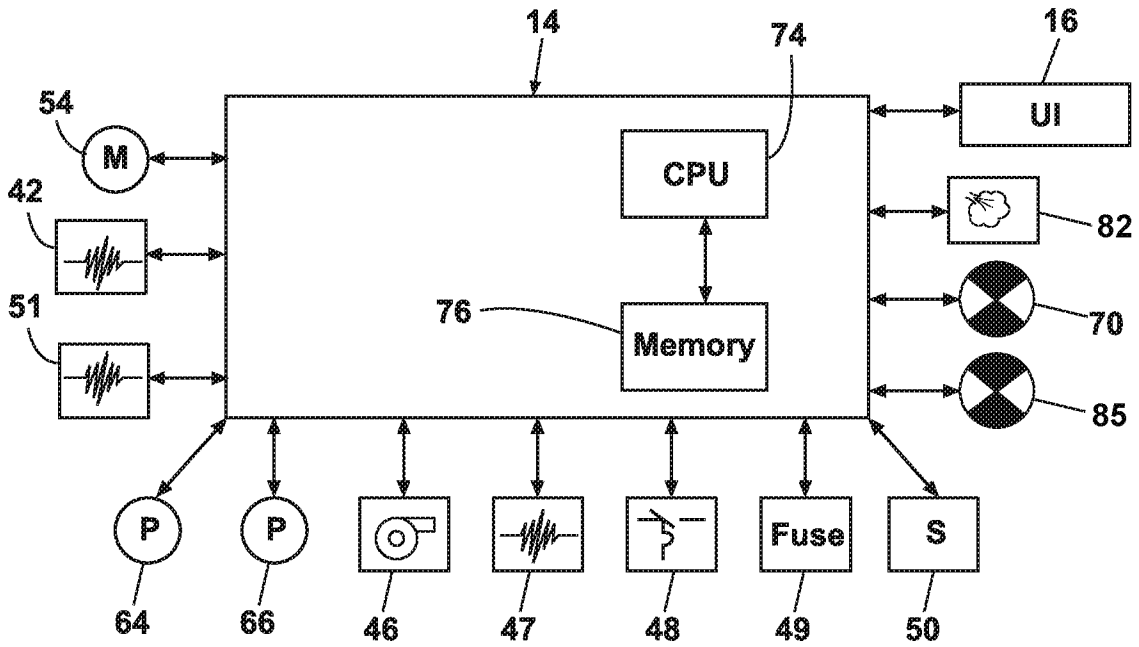
FIG. 2 is a schematic view of a controller of the clothes dryer in FIG. 1.

FIG. 2 is a schematic view of the controller 14 coupled to the various components of the dryer 10. The controller 14 can be communicably coupled to components of the clothes dryer 10 such as the heating element 42, blower 46, thermistor 47, thermostat 48, thermal fuse 49, thermistor 51, conductivity sensor 50, motor 54, inlet valve 70, pumps 64, 66, steam generator 82 and fluid control valve 85 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 can be provided with operational controls such as dials, lights, knobs, levers, buttons, switches, and displays enabling the user to input commands to a controller 14 and receive information about a treatment cycle from components in the clothes dryer 10 or via input by the user through the user interface 16. The user can enter many different types of information, including, without limitation, cycle selection and cycle parameters, such as cycle options. Any suitable cycle can be used. Non-limiting examples include, Casual, Delicate, Super Delicate, Heavy Duty, Normal Dry, Damp Dry, Sanitize, Quick Dry, Timed Dry, and Jeans.

The controller 14 can implement a treatment cycle selected by the user according to any options selected by the user and provide related information to the user. The controller 14 can also comprise a central processing unit (CPU) 74 and an associated memory 76 where various treatment cycles and associated data, such as look-up tables, can be stored. One or more software applications, such as an arrangement of executable commands/instructions can be stored in the memory and executed by the CPU 74 to implement the one or more treatment cycles.

In general, the controller 14 will effect a cycle of operation to effect a treating of the laundry in the treating chamber 34, which can or cannot include drying. The controller 14 can actuate the blower 46 to draw an inlet air flow 58 into the supply conduit 38 through the rear vent 37 when air flow is needed for a selected treating cycle. The controller 14 can activate the heating element 42 to heat the inlet air flow 58 as it passes over the heating element 42, with the heated air 59 being supplied to the treating chamber 34. The heated air 59 can be in contact with a laundry load 36 as it passes through the treating chamber 34 on its way to the exhaust conduit 44 to effect a moisture removal of the laundry. The heated air 59 can exit the treating chamber 34, and flow through the blower 46 and the exhaust conduit 44 to the outside of the clothes dryer 10. The controller 14 continues the cycle of operation until completed. If the cycle of operation includes drying, the controller 14 determines when the laundry is dry. The determination of a "dry" load can be made in different ways, but is often based on the moisture content of the laundry, which is typically set by the user based on the selected cycle, an option to the selected cycle, or a user-defined preference.

During a cycle of operation, one or more treating chemistries can be provided to the treating chamber 34 by the dispensing system 57 as actuated by the controller 14. To dispense the treating chemistry, the metering pump 64 is actuated by the controller 14 to pump a predetermined quantity of the treating chemistry stored in the reservoir 60 to the mixing chamber 62, which can be provided as a single charge, multiple charges, or at a predetermined rate, for example. The treating chemistry can be in the form of a gas, liquid, solid, gel or any combination thereof, and can have any chemical composition enabling refreshment, disinfection, whitening, brightening, increased softness, reduced odor, reduced wrinkling, stain repellency or any other desired treatment of the laundry. The treating chemistry can be composed of a single chemical, a mixture of chemicals, or a solution of a solvent, such as water, and one or more chemicals.

The conductivity sensors 50, 52 can include first and second electrodes 102, 104 (FIGS. 3A-3C) which are spaced from each other. When a wet article of laundry spans the two electrodes, a circuit is formed. A small current is supplied to one of the electrodes from the controller 14 and the other electrode is coupled to an input on the controller 14. When the circuit is formed by the article of laundry, the small current passes through the article of laundry to the other electrode, and the small current is passed to the controller 14 as an input. The completion of the circuit is often referred to as a "hit" in the art. The controller 14 has an algorithm that is used to process the input to determine if the hit is a valid hit, to keep track of the number of valid hits, the magnitude of the hits, the rate of change of the magnitude, the rate of change of the number of hits, and other characteristics of the hit and valid hits. The algorithm can also take into account the duration of the hits as the wet laundry item stays connected, as in the case the laundry item is stationary for some reason. The algorithm can also take into account the magnitude of the hits because as the article of laundry becomes drier, it generally becomes less conductive, and the magnitude of the input decreases. This decrease and/or rate of decrease may be used by the algorithm to determine or predict an end time for when the laundry is appropriately dry. This end time can be used to end the dry cycle and can be relayed to the user interface 16.

The number of conductivity sensors 50, 52 and their location relative to the treating chamber 34 are selected to provide more accurate drying information. The manner in which the controller 14 uses the input from the conductivity sensors 50, 52 is also selected to provide more accurate drying information. Also, the relative orientation of the two electrodes 102, 104 is also selected for more accurate drying information. For example, a plurality of orientations of the two moisture electrodes 102, 104 with respect to each other are contemplated in FIGS. 3A, 3B, 3C, and 3D. These orientations are for illustrative purposes and are not meant to be limiting.

A cross section of one of the conductivity sensors 50 with the electrodes 102, 104 in a stepped orientation is illustrated in FIG. 3A where the second moisture electrode 104 can be mounted to a step 106 formed to have half the width W/2 of the first moisture electrode 102. A similar orientation is depicted in FIG. 3B where the second moisture electrode 104 is mounted to a step matching the width W of the first moisture electrode 102. The width between the electrodes can be different from what is illustrated depending on the specific implementation. The amount of step and the width, W, can be varied to increase the likelihood of an article of laundry spanning the electrodes 102, 104 and completing the circuit to increase the number of hits.

Figure 3D:
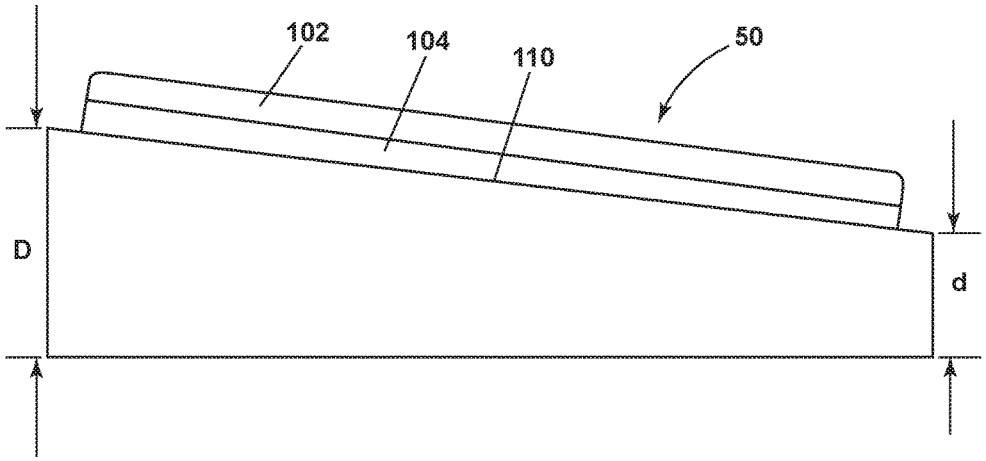

Furthermore as shown in FIG. 3C, both first and second moisture electrodes 102, 104 can be mounted to an inclined surface 108 such that the first moisture electrode 102 is axially rear of the second moisture electrode 104. A similar orientation is depicted in FIG. 3D where there is an inclined surface 108 like FIG. 3C and an angled surface 110 with respect to the rear wall 35 formed to protrude at a smaller distance d near a bottom of the rear wall 35 as compared to a distance D further from the bottom of the rear wall 35. Each distance is varied as needed to enhance the number of hits for a specific configuration.

Figure 4:
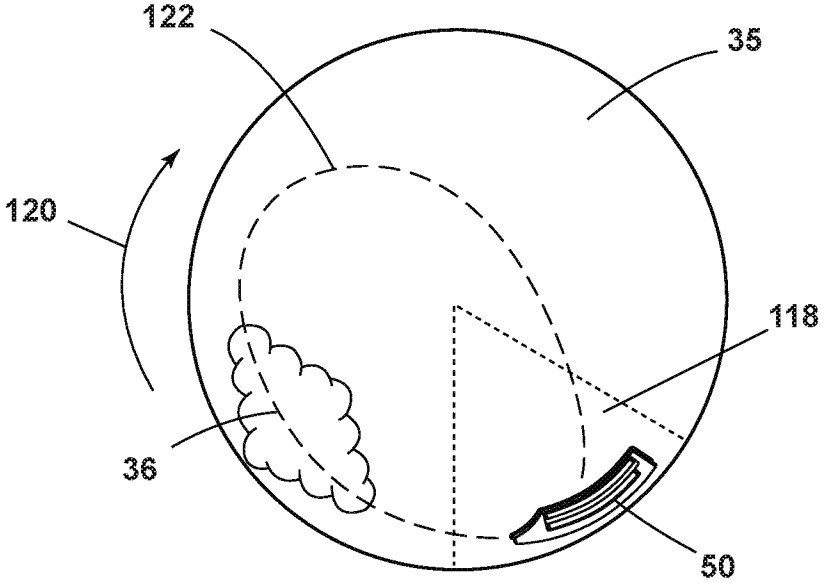
FIG. 4 is a schematic view for a location for the sensor from FIG. 1.

FIG. 4 is a schematic illustration looking at the rear wall 35 of the clothes dryer 10 from the open door where the first conductivity sensor 50 is mounted at a predetermined location 124 in a right, lower quadrant 118 of the rear wall 35. When in operation the motor 54 can rotate the drum 28 clockwise 120 at a predetermined speed. Different speeds may result in different expected trajectories for the laundry 36. The predetermined speed is selected in part to induce the laundry 36 to tumble generally along a desired expected trajectory 122. The first conductivity sensor 50 is mounted at the predetermined location 124 such that the expected trajectory 122 passes through the sensor 50, improving the likelihood that the laundry 36 will contact the moisture electrodes 102, 104 when tumbled.

As explained, the expected trajectory 122 can be selected as desired based on selection of the predetermined speed. Preferably, the predetermined speed is chosen such that the expected trajectory 122 causes the laundry 36 to pass over the conductivity sensors 50, 52 regardless of the direction of rotation or the quadrant in which the sensor is located. Preferably, the expected trajectory 122 is selected to traverse opposite quadrants for a given direction of rotation. For example, as illustrated in FIG. 4 in the case of clockwise rotation, the expected trajectory 122 was selected to pass through the upper left and lower right quadrants, giving the laundry 36 a longer travel path during operation in which the laundry can be exposed to heated air passing through the treating chamber 34.

A method of controlling a drying cycle of the clothes dryer 10 includes rotating the treating chamber 34 at the predetermined speed such that laundry 36 within the treating chamber tumbles along the selected expected trajectory 122, passing over the first conductivity sensor 50 at the rear of the treating chamber 34.

Information regarding the moisture content of the laundry is gathered from the first conductivity sensor 50 as hits and relayed to the controller 14 as a first output signal. The first output signal can be used by the controller 14 to determine the moisture content of the laundry. Duration of the drying cycle of operation can then be determined based on the first output signal.

Laundry 36 also passes over the second conductivity sensor 52, which is located at the front of the treating chamber 34. Information gathered by the second conductivity sensor 52 can also be relayed to the controller 14 as a second input signal. The duration of the drying cycle can be determined based on some combination of or selection between the first and second output signal. The selection of the signal used can be based on which output signal relayed a higher amount of moisture content in the laundry. This can be determined by, for example, the number of hits detected by each of the conductivity sensors 50, 52, when laundry made contact with the moisture electrodes 102, 104. Terminating the drying cycle occurs upon expiration of any remaining dry time as determined by the first or second output signals.

Additionally the thermistor 47 located in the supply conduit 38 and the thermistor 51 located in the exhaust conduit 44 can each generate a third and fourth output signal indicative of an air temperature in the supply and exhaust conduits, respectively. These air temperature readings supply additional information to the controller, which uses the information to more accurately determine the moisture content of the laundry, rate of moisture decrease, and/or remaining duration of the drying cycle of operation. The method can further include selecting by the controller at least one of the first, second, third, and fourth output signals to control the duration of the drying cycle of operation.

The treating chamber 34 can be oriented on an angle relative to a horizontal where laundry 36 will tend to migrate toward the rear wall 35 during tumbling. In this case it is anticipated that the first conductivity sensor 50 located on the rear wall 35 will receive a greater number of hits. During any particular cycle the laundry 36 can move from the rear 32 to the front 32 multiple times, so it is understood that while it is more likely in such a scenario that the first conductivity sensor 50 would receive more hits, the second conductivity sensor 52 may still receive hits, and in some cases more hits, wherein the output signal from the second conductivity sensor 52 would still be used. Alternatively, the axis can be horizontal and the hits received by both the first and second conductivity sensors 50, 52 could be more equal so it is contemplated that if the hits between the front 30 and rear 32 are equal or within a predetermined range of each other, then the controller 14 can use the input from both sensors 50, 52.

Figure 5:
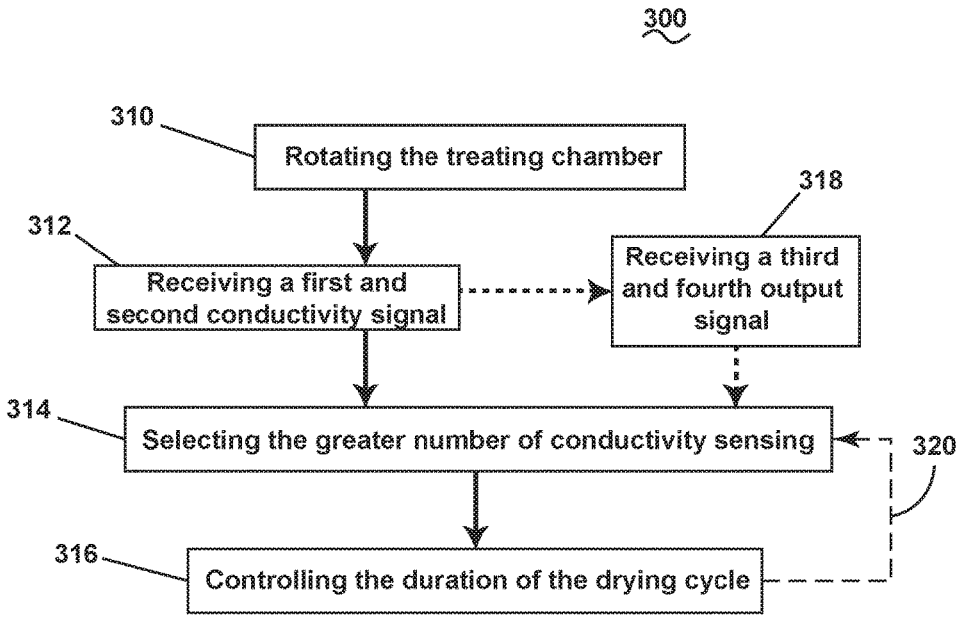
FIG. 5 is a flow chart of a method for a drying cycle for the clothes dryer of FIG. 1.

A method 300 for controlling a drying cycle of operation in a laundry treating appliance for drying laundry is illustrated in FIG. 5 and includes at 310 rotating the treating chamber 34, wherein the rotation of the treating chamber 34 is at a predetermined speed so the laundry 36 travels along the expected trajectory 122, where the laundry passes over the predetermined location of the conductivity sensors 50, 52. Then receiving at 312 a first and second conductivity signal from the first and second conductivity sensors 50, 52 at the controller 14, wherein the conductivity signals are translated to information regarding the moisture content of the laundry 36 relative to the number of hits recorded. Next selecting at 314 the greater number of the conductivity sensings, between the first and second signals by the controller 14, and using the selected conductivity sensings to determine a duration of drying time. Finally controlling at 316 the duration of the drying cycle of operation based on the selected one of the first and second signals.

The method 300 can also include receiving at 318 a third and fourth output signal at the controller from the first and second thermistors 47, 51 which include information regarding temperatures at the supply conduit and the inlet conduit wherein the difference between these temperatures can be used to determine the moisture content of the laundry. The controlling 316 of the duration of the drying cycle can then be determined by one of the first, second, third, and fourth output signals or a combination of less than all of them where the output signal indicating the most moisture left in the laundry is ultimately the output signal used to determine the duration of the drying cycle.

The method 300 can include repeatedly selecting at 320 between the first and second conductivity signals in order to repeatedly control the duration of the drying cycle based on the signals during the duration of the drying cycle of operation. The duration of the drying cycle can change upon receiving updated signals, which can be for example but no limited to cycled updates, occurring automatically once a signal has been received, in the event that laundry 36 is drying at a different rate than initially determined when selecting at 314 the greater number of conductivity sensings. The repeatedly selecting at 318 can occur throughout the duration of the drying cycle.

Figure 7:
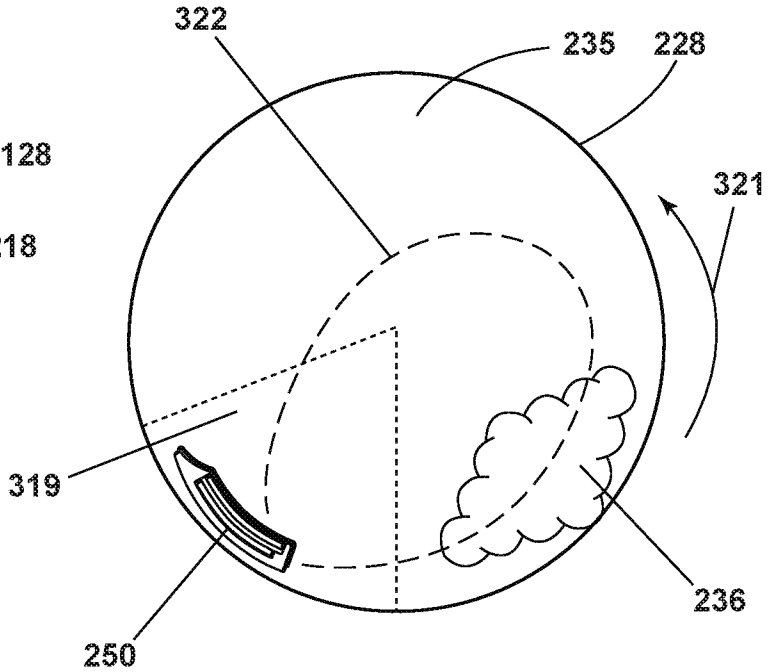
FIG. 7 is a schematic view of a third embodiment of the sensor location in FIG. 4
Figure 6:
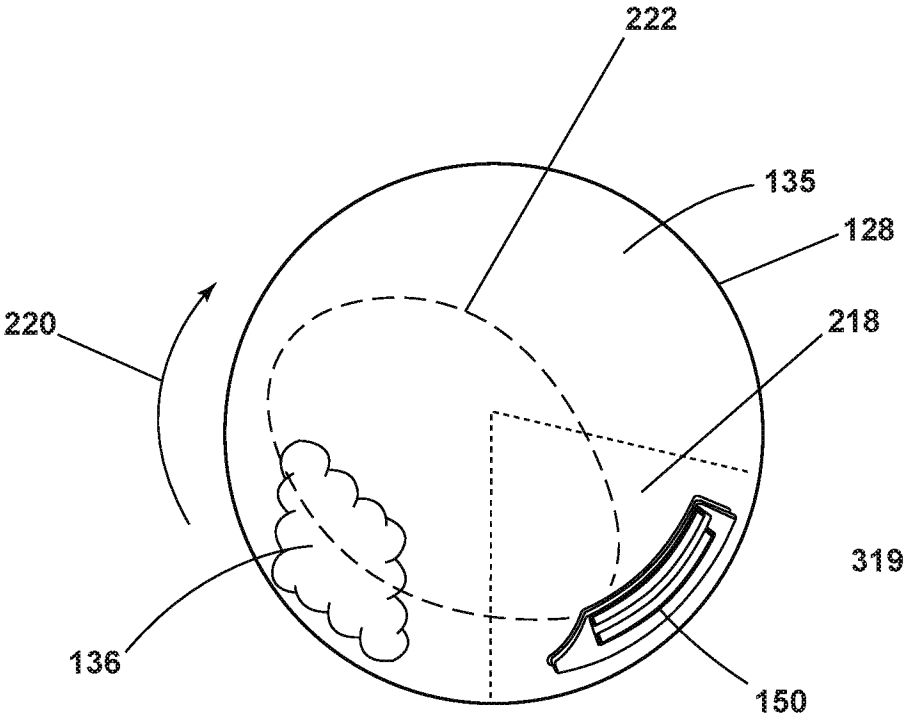
FIG. 6 is a schematic view of a second embodiment of the sensor location in FIG. 4.

Turning to FIGS. 6 and 7, alternative embodiments to the embodiment of FIG. 4 are illustrated an like parts identified by like numerals increasing by 100, with it being understood that the description of the like parts of the first embodiment applies to the additional embodiment, unless otherwise noted.

FIG. 6 depicts a first conductivity sensor 150 located in a similar position of the embodiment described in FIG. 3, only the first conductivity sensor 150 is elongated. Additional length enables more contact with the laundry load 136. It can also be contemplated that two smaller conductivity sensors (not shown) could be placed in series to achieve the same effect.

FIG. 7 depicts a first conductivity sensor 250 located in a lower quadrant 319 opposite the quadrant 118 depicted in FIG. 4. This embodiment could be implemented in a drum 228 that rotates counter-clockwise 321 or be utilized in a drum 228 where manufacturing constraints prevent mounting the sensor 250 in the location shown in connection with the embodiment of FIG. 3.

Benefits associated with the embodiments described herein include increasing efficiency and effectiveness of a dryer by providing multiple inputs of information to the controller 14 regarding the moisture content of laundry 36 in the drum 28. For example, a larger load may produce dry signals to one of the conductivity sensors 50, 52 while part of the load is still retaining moisture.

Providing a conductivity sensor in an additional location where the load is predicted to pass by increases the probability of gathering the correct information regarding moisture content of the entire load therefore ensuring timely dry cycle duration and dry laundry for the user at the end of each cycle.

Specifically, having a laundry treating appliance for drying laundry in which a first conductivity sensor located at the rear of the treating chamber with a motor rotating the drum at a predetermined speed to tumble laundry within the treating chamber over a predetermined location within the treating chamber wherein the first conductivity sensor is located at the predetermined location enables more efficient and timely drying cycles. Determining the predetermined location with an expected trajectory allows for more accurate placement of the first conductivity sensor.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims can be combined with each other in any possible combination, even if the combinations have not been expressly claimed.

What is claimed is:

1. A laundry treating appliance for drying laundry comprising:

a rotatable drum at least partially defining a treating chamber and having a front and a rear;

a first conductivity sensor located on a lower portion of a rear of the laundry treating appliance;

a second conductivity sensor located at a lower portion of the front of the treating chamber; and a motor rotating the drum at a predetermined speed to tumble laundry within the treating chamber such that a trajectory of the laundry passes over the first and second conductivity sensors.

2. The laundry treating appliance of claim 1 wherein the first conductivity sensor is located at one of a lower right or lower left quadrant of the rear.

3. The laundry treating appliance of claim 1 further comprising an air system having a supply conduit through which air is supplied to the treating chamber, an exhaust conduit through which air is exhausted from the treating chamber, and at least one thermistor located in the supply conduit or exhaust conduit and generating an output signal indicative of a temperature.

4. The laundry treating appliance of claim 3 wherein the at least one thermistor comprises a first thermistor located in the supply conduit and generating a third output signal indicative of an air temperature in the supply conduit, and a second thermistor located in the exhaust conduit and generating a fourth output signal indicative of an air temperature in the exhaust conduit.

5. The laundry treating appliance of claim 1 wherein the drum comprises an open rear and a rear wall closes the open rear.

6. The laundry treating appliance of claim 5 further comprising a rear bulkhead defining the rear wall and rotationally supporting the open rear of the drum.

7. The laundry treating appliance of claim 6, wherein the second conductivity sensor is located on a front bulkhead rotationally supporting an open front of the drum.

8. A method of controlling a drying cycle of operation in a laundry treating appliance for drying laundry, the method comprising rotating a treating chamber at a predetermined speed such that a trajectory of laundry within the treating chamber passes over a first conductivity sensor located at a lower rear of the treating chamber and a second conductivity sensor located at a lower front of the treating chamber.

9. The method of claim 8 further comprising using a first output signal from the first conductivity sensor to control a duration of the drying cycle of operation.

10. The method of claim 9 further comprising continuously updating the duration of the drying cycle of operation.

11. The method of claim 10 further comprising selecting by a controller one of the first output signal and a second output signal.

12. The method of claim 11 further comprising using the selected one of the first and second output signals to control the duration of the drying cycle of operation.

13. The method of claim 12 wherein the selecting comprises selecting the one of the first and second output signals that have a greater number of conductivity sensings.

14. The method of claim 8 wherein the treating chamber is rotated about an axis that is angled relative to a horizontal.

15. The method of claim 11 further comprising receiving at the controller a third and fourth output signal from a first thermistor coupled to a supply conduit and a second thermistor coupled to an exhaust conduit forming at least a portion of an air system.

16. The method of claim 15 further comprising selecting by the controller at least one of the first, second, third, and fourth output signals to control the duration of the drying cycle of operation.

17. The method of claim 16 further comprising the controller selecting less than all of the first, second, third and fourth output signals.

18. A method of controlling a drying cycle of operation in a laundry treating appliance for drying laundry, the method comprising:

receiving at a controller for the laundry treating appliance a first conductivity signal from a first conductivity sensor at a lower rear of treating chamber and a second conductivity signal from a second conductivity sensor at a lower front of the treating chamber;

rotating the treating chamber such that a trajectory of laundry in the treating chamber passes over the first and second conductivity sensors;

selecting by the controller one of the first conductivity signal or the second conductivity signal having a greater number of conductivity sensings; and controlling duration of the drying cycle of operation based on a selected first conductivity signal or second conductivity signal.

19. The method of claim 18 further comprising repeatedly selecting between the first and second conductivity signals.

20. The method of claim 18 further comprising receiving at the controller a third and fourth output signal from a first and second thermistor forming at least a portion of an air system proximate the treating chamber.

* * * * *